US009004715B1

(12) United States Patent
Litke et al.

(10) Patent No.: US 9,004,715 B1
(45) Date of Patent: Apr. 14, 2015

(54) MODULAR STRUCTURAL FRAME LIGHTING

(75) Inventors: Mark Litke, Hudsonville, MI (US); Marc Zuiderveen, Hudsonville, MI (US); Peter Mokris, Hudsonville, MI (US); Phil VonTom, Hudsonville, MI (US); Fred Finke, Hudsonville, MI (US)

(73) Assignee: Emergency Technology, Inc., Hudsonville, MI (US)

( * ) Notice: Subject to any disclaimer, the term of this patent is extended or adjusted under 35 U.S.C. 154(b) by 691 days.

(21) Appl. No.: 13/227,976

(22) Filed: Sep. 8, 2011

Related U.S. Application Data

(60) Provisional application No. 61/381,668, filed on Sep. 10, 2010.

(51) Int. Cl.
*F21V 29/00* (2006.01)
*F21S 4/00* (2006.01)
*F21V 21/35* (2006.01)

(52) U.S. Cl.
CPC ..... *F21V 21/35* (2013.01)

(58) Field of Classification Search
CPC ..... F21S 4/00; F21S 4/001; F21S 4/003; F21S 4/008; F21S 2/005; H05K 1/142; F21V 21/14; F21V 21/145; F21V 23/06; F21V 23/00; F21V 23/001; F21V 23/003; F21V 23/004; F21V 23/005; F21V 23/007; F21V 19/0005; F21Y 2103/00; F21Y 2103/003; F21Y 2101/02; F21L 4/00; F21L 4/02; F21K 9/00
USPC ..... 362/217.01, 217.02, 217.1, 217.11, 362/217.12, 217.13, 217.14, 217.15, 362/217.16, 217.17, 219, 220, 221, 222, 362/223, 225, 249.01, 249.02, 249.06, 127, 362/129, 133, 145, 152, 218; 52/28; 312/223.5, 223.6
See application file for complete search history.

(56) References Cited

U.S. PATENT DOCUMENTS

| | | | | |
|---|---|---|---|---|
| 4,639,841 | A * | 1/1987 | Salestrom et al. | 362/227 |
| 5,105,179 | A | 4/1992 | Smith | |
| 5,337,225 | A * | 8/1994 | Brookman | 362/145 |
| 5,429,438 | A | 7/1995 | Wood | |
| 5,803,579 | A | 9/1998 | Turnbull et al. | |
| 5,893,633 | A | 4/1999 | Uchio et al. | |
| 6,250,774 | B1 | 6/2001 | Begemann et al. | |
| 6,481,177 | B1 | 11/2002 | Wood | |
| 6,561,690 | B2 | 5/2003 | Balestriero et al. | |
| 6,586,890 | B2 | 7/2003 | Min et al. | |
| 7,262,559 | B2 | 8/2007 | Tripathi et al. | |
| 7,348,604 | B2 | 3/2008 | Matheson | |
| 7,566,155 | B2 | 7/2009 | Schug et al. | |
| 7,703,941 | B2 * | 4/2010 | Lee | 362/219 |
| 8,215,786 | B2 * | 7/2012 | Sloan et al. | 362/145 |
| 2002/0122691 | A1 | 9/2002 | Wood | |
| 2003/0063463 | A1 | 4/2003 | Sloan et al. | |
| 2007/0274067 | A1 * | 11/2007 | Sloan et al. | 362/219 |

* cited by examiner

*Primary Examiner* — Thomas M Sember
(74) *Attorney, Agent, or Firm* — McGarry Bair PC

(57) ABSTRACT

A modular lighting assembly for a modular frame piece comprising a power module, a heat spreader, a circuit board with traces that provide electrical pathways, at least one illumination element, and a cover. The circuit board is disposed upon the heat spreader, the cover is disposed upon the circuit board and encapsulates the circuit board, the power module is electrically connected to the traces on the circuit board. The traces on the circuit board are electrically connected to the at least one illumination element to enable power transfer from the power module to the at least one illumination element. The modular lighting assembly can be slidably disposed within a slot of a modular frame profile.

16 Claims, 11 Drawing Sheets

MODULAR STRUCTURAL FRAME LIGHTING

CROSS-REFERENCE TO RELATED APPLICATION

This application claims the benefit of U.S. Provisional Patent Application Ser. No. 61/381,668, filed Sep. 10, 2010, which is incorporated herein by reference in its entirety.

BACKGROUND OF THE INVENTION

1. Field of the Invention

This invention relates lighting and illumination. In one of its aspects, the invention relates to illumination solutions for modular structural frame assemblies formed of profile extrusions. In another of its aspects, the invention relates to a non-pixilated, linear illumination system for integrating illumination into structural frame profiles. In another of its aspects, the invention relates to a joint construction for structural frame profiles that mechanically connects profiles together and integrates electrical connectors for building structural frame systems that also integrates electrical lighting in selectable advantageous locations and for driving multiple lighting modules from a single power source. In another of its aspects, the invention relates to a structural frame system that efficiently integrates illumination at strategic locations with less clutter and lower cost. In another of its aspects, the invention relates a structural frame profile with integrated lighting. In another of its aspects, the invention relates to a connector for structural frame profiles that mechanically and electrically connect the structural frame profile together. In another of its aspects, the invention relates to a modular lighting assembly that is adapted to integrate illumination to modular framework for office work environments, machine vision, storage rack/shelving, walkways, platforms, institutional and retail ceiling grids, medical clinical and labs, outdoor environments and other similar areas with structural frame profiles.

2. Description of the Related Art

Modular structural frames formed from profile extrusions are commonly used for rapid construction of frame assemblies for work space environments in offices, factories and in public area inside outside. The modular framing profiles may contain multiple slots that run along the length of the structure within which connecting pieces may be seated to connect one modular frame profile to another. By connecting multiple modular framing profiles, it is possible to construct frame assemblies for furniture, enclosures, and supports for equipment. Examples of these modular structural frames are disclosed in U.S. Pat. Nos. 6,481,177 and 5,429,438, and in US Published Patent Application US20020122691, the content of which references are incorporated herein by reference in their entirety. In addition, these structural frame assemblies are sold by various suppliers and under various brand names including 80/20 Incorporated®, MiniTec Framing Systems®, Unitstrut®, and Air Incorporated®.

Conventional lighting fixtures such as fluorescent and incandescent fixture can be suspended from the structural profiles in strategic locations. These fixtures may require the work of electricians to install and typically require a separate power source, such as a convenience outlet for each fixture. In addition, the hanging fixtures with unmanaged power cords tend to compromise the aesthetic appearance of the structural frame systems and add to clutter in work areas.

BRIEF DESCRIPTION OF THE INVENTION

According to the invention, a modular frame assembly with modular lighting assemblies comprises a plurality of modular structural frame profiles joined together to form a support structure, each of the modular frame profiles having at least one longitudinal slot extending along the length of the profile; at least one modular lighting assembly at least partially disposed within the at least one slot of at least one of the plurality of modular frame profiles and a power source to energize the at least one modular lighting assembly to provide visible radiation external to the modular frame assembly.

In one embodiment, the modular frame profiles are mechanically connected to one another with at least one corner connector that provides electrical connection between each of the adjacent connected modular frame profiles.

In another embodiment, the at least one modular lighting assembly is slidably mounted within the at least one slot of the at least one of the plurality of modular frame profiles. To this end, the modular frame profile slot comprises inwardly directed lips that slidably retain the at least one modular lighting assembly.

In addition, the at least one modular lighting assembly can include at least one illumination element mounted on a circuit board and a heat spreader mounted on the circuit board. The heat spreader can be configured to complement the profile of the at least one longitudinal slot so that the outer surface of the heat spreader is in close proximity to or actually touches interior walls of the at least one longitudinal slot.

In another embodiment, the at least one modular lighting assembly includes a power module and a switch connected between the power module and the at least one modular lighting assembly.

In yet another embodiment, the at least one illumination element comprises at least one light emitting diode (LED). In addition, the at least one modular lighting assemblies can further include at least one reflective element and/or at least one optically diffusive element.

Further according to the invention, a modular lighting assembly for a modular frame profile comprises a power module; a lighting module that can include a heat spreader; a circuit board mounted to the heat spreader and including traces that provide electrical pathways and at least one illumination element. The power module can be electrically connected to the traces on the circuit board, the traces on the circuit board can be electrically connected to the at least one illumination element to enable power transfer from the power module to the at least one illumination element. Further, the power module and the lighting module can be configured to be slidably received within an elongated slot of a modular frame profile.

In one embodiment, a switching module can be disposed between the power module and the lighting module for actuating the illumination element. In addition, the at least one illumination element can be a light emitting diode (LED).

Still further according to the invention, an illumination assembly for work areas and the like comprises a structural frame profile having at least one longitudinal slot extending along the length of the frame profile having an elongated profile with at least one longitudinal slot with retaining lips defining an opening to the elongated slot, and a modular lighting assembly as described above slidably mounted in the at least one longitudinal slot.

Still further according to the invention, a structural frame profile connector for modular elongated structural frame profiles comprises a body having a first guide that is configured to be slidably received in at least one elongated slot of a frame profile; a second guide that is configured to be slidably received in at least one elongated slot of an adjacent frame profile; an electrical input disposed at a distal end of the first guide; and an electrical output disposed at a distal end of the second guide wherein the electrical input and electrical output are electrically connected to each other. In addition, a mechanical connector can be mounted in the body adjacent to each of the first and second guides to mechanically secure the frame profile connector to the two adjacent frame profiles.

In one embodiment, the first guide is positioned substantially perpendicular to the second guide.

DESCRIPTION OF AN EMBODIMENT OF THE INVENTION

Figure 1:
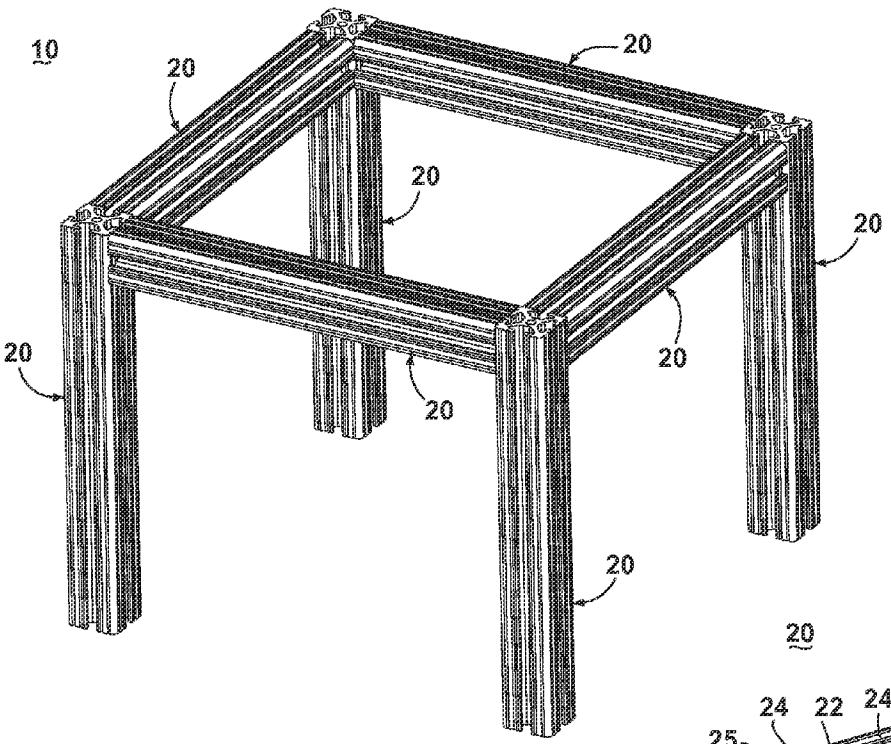
Fig. 1 (PRIOR ART)
FIG. 1 is a schematic illustration of a prior art frame assembly formed of multiple modular framing profiles.
Figure 2:
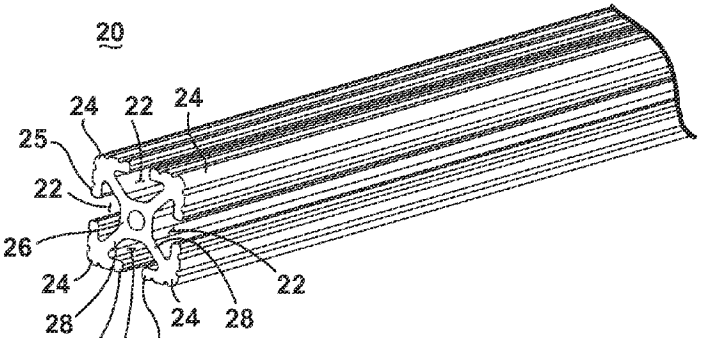
Fig. 2 (PRIOR ART)
FIG. 2 is a schematic illustration a prior art modular framing profile.

Referring now to the drawings and to FIGS. 1 and 2 in particular, a prior art frame assembly 10 is formed by connecting multiple modular framing profiles 20 using corner connectors (not shown). An individual modular framing profiles 20 is illustrated in FIG. 2. The modular framing profiles 20 are of a predefined length and cross section. The particular modular framing profile 20 shown is typically referred to as a T-slotted structure and is characterized by a square cross-sectional shape and four T slots 22 formed by a central core 26 and four outwardly directed legs 28 terminating in lobes 24 with inwardly directed lips 25 extending along the length. The T slots 22 as shown, may have a re-entrant profile formed by retaining lips 25 at each side of the where the portion of the slot 22 close to the outside of the edge of the modular framing profiles 20 is narrower than the width of the slot 22 toward the center of the modular framing profiles 20. The four lobes 24 extend along the length of the profile and define the outer edges of the T-slotted modular framing profiles 20, between which the four slots 22 lie.

Since the cross sectional profile of the modular framing profiles 20 is the same throughout its length, the modular framing profiles 20 are well suited to be manufactured by an extrusion process. Extrusion is a particularly cost effective means of fabricating such structures. However, any other known fabrication may be used to form these structures including casting methods. Aluminum is typically used to fabricate the modular framing profiles 20 due to it favorable properties, including low cost, hardness, ductility, thermal conductance, relatively high melting point, weight, and corrosion and oxidation resistance. Materials other than aluminum may also be used to construct the modular framing profiles, including stainless steel, iron, copper, nickel, tin, cobalt, tungsten, molybdenum, titanium, chromium or any combinations or alloys containing any of the materials listed. Other alternative materials may also include thermoplastic material, reinforced thermoplastics, or glass. The volume enclosed by the modular framing profiles 20, contains a substantial portion of free space, as the slots 22 and the hole 28. This further reduces the weight of the modular framing profiles 20 and the consumption of aluminum or the material of construct to keep the material cost low. Alternatively, one or more of the slots 22 may be filled in with aluminum or any other material. Additionally, one or more of the lobes 24 may be connected to one another. Such a structure may result in one or more slots 22 being closed off to the outside of the modular framing profiles 20 along its length and only accessible at the ends of the modular framing profiles 20. There are various other known types of modular framing profiles. However, any of these other types of modular framing profiles contain at least one slot and the embodiments disclosed herein are applicable to any of the known types of modular framing profiles and not limited to T-slotted modular framing profiles.

The modular framing profiles 20 may further contain holes (not shown) intermittently spaced along the length of the modular framing profiles 20 into the center element 26. These holes in the center element 26 may be used to secure connecting pieces, for example by screws, for the purpose of attaching one modular framing profiles 20 to another modular framing profiles 20. A detailed description of exemplar modular framing profiles are disclosed in United States Patent to 80/20 Inc., U.S. Pat. No. 5,429,438, which is hereby incorporated by reference in its entirety.

Figure 3:
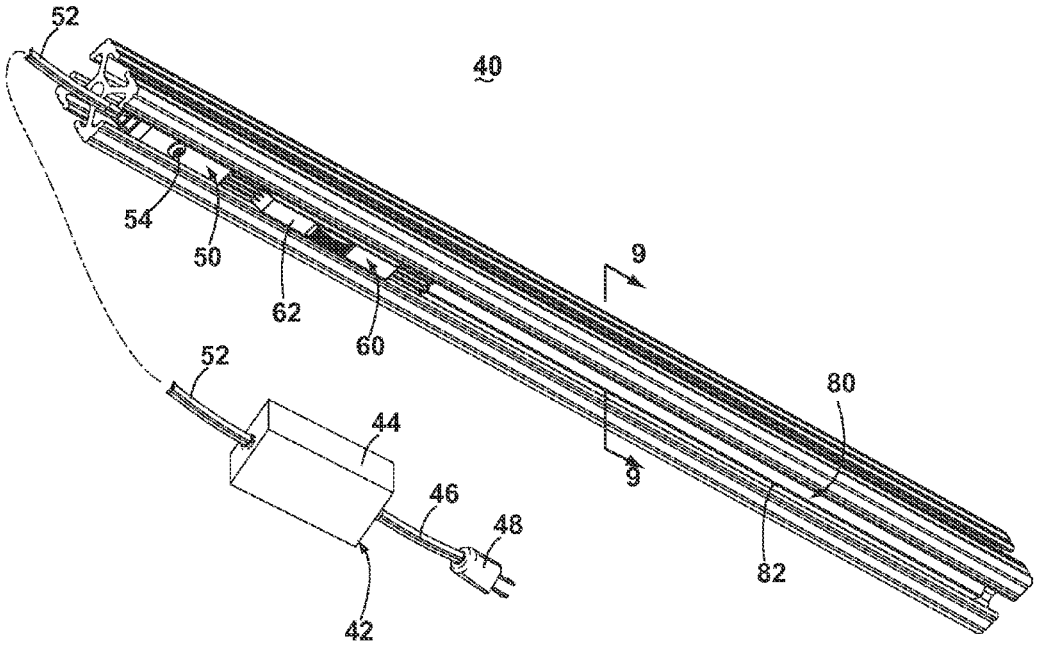
FIG. 3 is a perspective view of a modular framing profile with a lighting module assembly according to the invention disposed within a modular framing profile.
Figure 4:
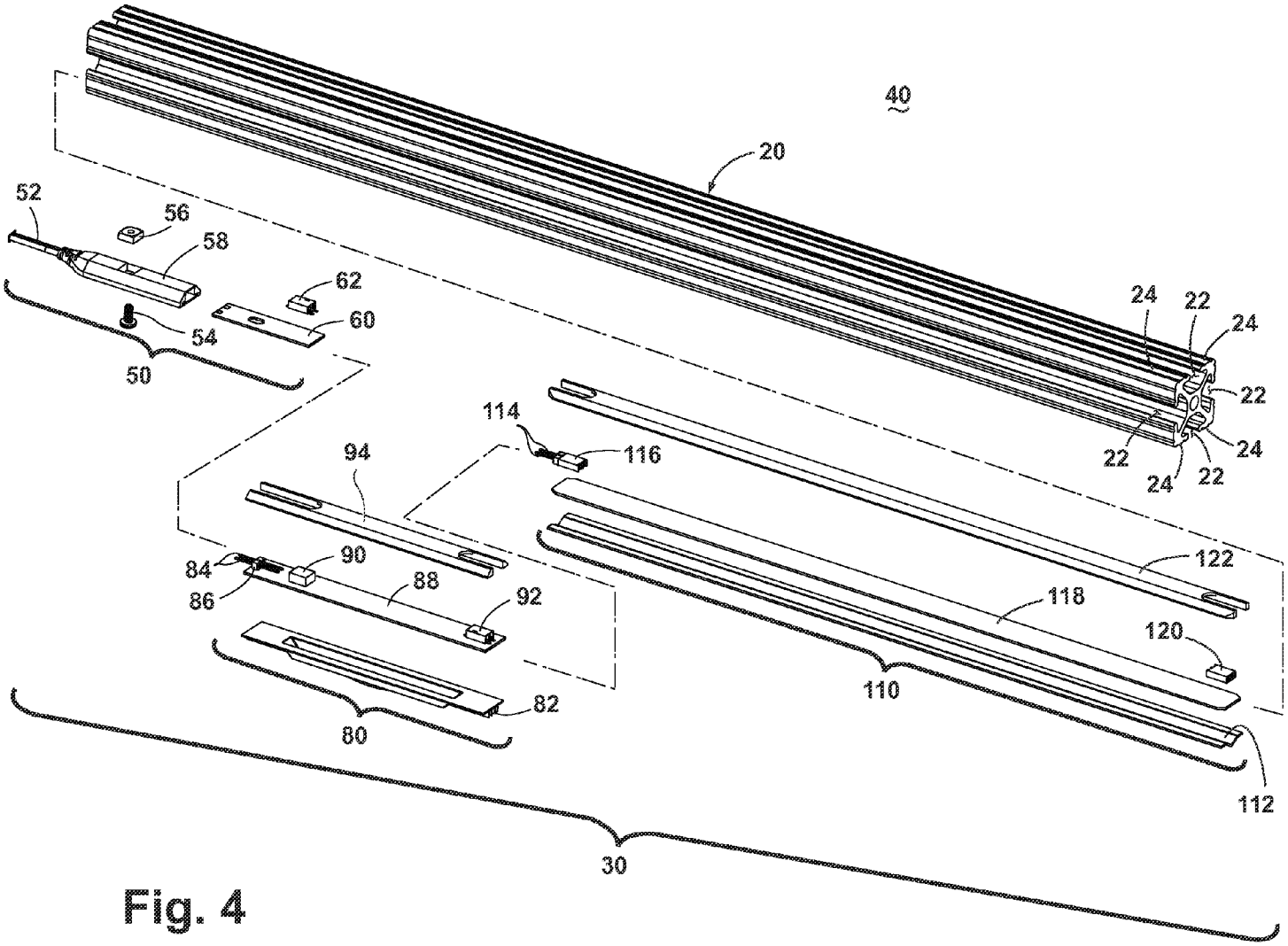
FIG. 4 shows an exploded view of the lighting module assembly illustrated in FIG. 3.

Referring now to FIGS. 3 and 4, a modular lighting assembly 30 according to the invention is disposed within the modular framing profiles 20 to form an integrated modular framing profile with modular lighting 40. The modular lighting assembly 30 comprises a power module portion 50, a switch module portion 80, and a lighting module portion 110. The power module portion 50 contains a power cord 52 and a snap-in knob 54 to secure the components (FIG. 4) of power module portion 50. The power cord 52 may be connected to a power connector 42, with a main body 44, electrical cord 46, and plug 48. The plug may fit into a standard wall power outlet to draw power to the power connector 42 via the electrical cord 46. The main body may contain an alternating current (AC) to direct current converter (DC). The AC power draw and the DC power output of the power connector 42 will depend on the number of modular lighting assemblies 30 being powered by the power connector 42. For example, in the case of the power connector 42 powering between 1 to 3 modular lighting assemblies 30, the power output may be 16 W. If a single power connector 42 is powering 10 or more modular lighting assemblies 30, then the power output may be 100 W. Alternatively, the power connector 42 may have the means to provide a variable level of power output based on the number of modular lighting assemblies 30 being driven from it. The switch portion 80 contains a top switch cover 82 and is connected to the power module portion 50 on one end and the lighting module portion 110 on the other end. The lighting module portion 110 has a top lighting cover 112. Each of the power module portion 50, switch module portion 80, and the lighting module portion 110 are described in greater detail in conjunction with FIGS. 4-9.

The power module portion 50, switch module portion 80, and the lighting module portion 110 are shown as being directly connected to each other in FIG. 3. However, each of the portions 50, 80, and 110, may be connected via a connector wire therebetween without changing the scope of the invention. It may be advantageous to connect the various portions with an intermediate connector wire for ergonomic or aesthetic purposes. For example, the lighting module portion 110 to provide proper lighting may need to be in a portion of a frame assembly that is not easily accessible. In such a case, the switch module portion 80 can be connected to the lighting module portion 110 via a connector wire so that the switch module portion 80 can be placed in a more accessible and ergonomic position compared to the lighting module portion 110.

FIG. 4 shows an exploded view of the integrated modular framing profiles with modular lighting assembly 40. All of the portions of the modular lighting assembly 30 fit into one or more of the slots 22 as defined by the spaces between the lobes 24 of the modular framing profiles 20. The power module portion 50 comprises the power cord 52, the knob 54, a molded piece 58, a power circuit board 60, and electrical outlet 62. The purpose of the power module portion is to provide power to the modular lighting assembly 30 either from a corner connector as will be discussed in conjunction with FIGS. 10-19 or from a power supply system. The power module portion is described in greater detail in conjunction with FIG. 5.

The electrical outlet 62 of the power module portion 50 is a female electrical connector and mates with prongs 84 of a switch electrical input 86 of the switch module portion 80 of the modular lighting assembly 30. The switch portion 80 also contains a switch circuit board 88 on which various components may be mounted, such as power regulator 90 and a switch power output 92. The switch circuit board 88 with various components mounted thereon are sandwiched between the top switch cover 82 and a molded spacer 94. The switch module portion is described in greater detail in conjunction with FIGS. 6 and 7.

Continuing with FIG. 4, the switch power output 92 is a female electrical connector and mates with prongs 114 of a lighting electrical input female connector 116 of the lighting module portion 110. The lighting module portion 110 further contains a lighting circuit board 118, on which the lighting electrical input female connector 116 and a lighting electrical output 120 are mounted thereon. The lighting circuit board 118 is sandwiched between the top lighting cover 112 and a bottom lighting heat spreader 122. The lighting module portion is described in greater detail in conjunction with FIG. 8.

Figure 5:
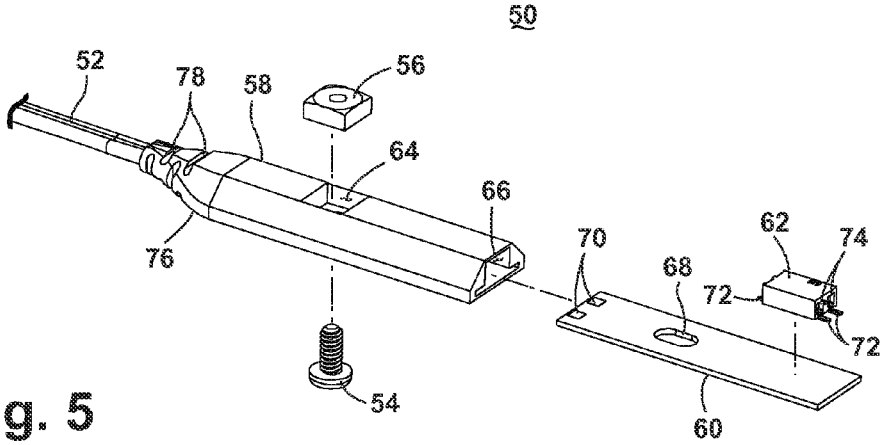
FIG. 5 is an exploded view the power module portion of the lighting module assembly.

An exploded view of the power module portion 50 is shown in FIG. 5. The power cord 52 is connected to the molded piece 58 by an intermediate cord portion 76, which may contain notches 78 to provide flexibility to the intermediate cord portion 76. The intermediate cord portion 76 may be formed with the molded piece by any known method such as injection molding of thermoplastic materials such as polyvinyl chloride (PVC) or Polyethylene terephthalate (PET). There are two cavities, a nut cavity 64 and a board cavity 66, within the molded piece 58. The backing nut 56 fits into the nut cavity 64 when the screw 54 is secured to the backing nut 56. The power circuit board 60 with components mounted thereon fits into the board cavity 66 within the molded piece 58. There is a hole 68 within the power circuit board 60 so that when the circuit board is disposed within the board cavity 66, the screw 54 passes through the hole 68 and is screwed into the backing nut 56 to secure the power circuit board 60 within the board cavity 66. Alternatively, a screw 54 and backing nut 56 may not be used for securing the power circuit board 60 within the molded piece 58. Any other known method of securing the power circuit board 60 may be used, including, but not limited to molding the molded piece 58 around the power circuit board 60.

The board cavity 66 is shaped to accommodate components that are connected on the power circuit board 60, such as the electrical outlet 62. The electrical outlet 62 has female electrical connectors 74 for connecting to corresponding male prongs 84 of the switch module portion 80. Alternatively the electrical outlet 62 may connect directly to the lighting module portion 110. The electrical outlet 62 may have electrical mounts 72 to connect the electrical outlet 62 to connection pads (not shown) on the power circuit board 60. Components such as the electrical outlet 62 may be connected to the power circuit board by any known method, including through hole or surface mount methods utilizing wave soldering or screen printed solder paste technology. The electrical wires (not shown) contained within the power cord 52 may connect to connection pads 70 on the power circuit board 60. The power circuit board 60 has electrical traces (not shown) to transmit electrical power from the connection pads 70 to the electrical mounts 72 of the electrical outlet 62.

Conventional lead-tin (Pb—Sn) solder materials may be used for making electrical connections on the power circuit board 60. Alternatively, Tin-Silver-Copper (SAC) alloys may be used to comply with more stringent Restrictions of Hazardous Substances (RoHS) standards and more stringent lead contamination prevention standards in Europe and Japan. One method of fabricating the power module portion may be to assemble components such as the electrical outlet 62 onto the power circuit board 60 and then form the molded piece 58 around the power circuit board by injection molding of thermoplastic materials.

Figure 7:
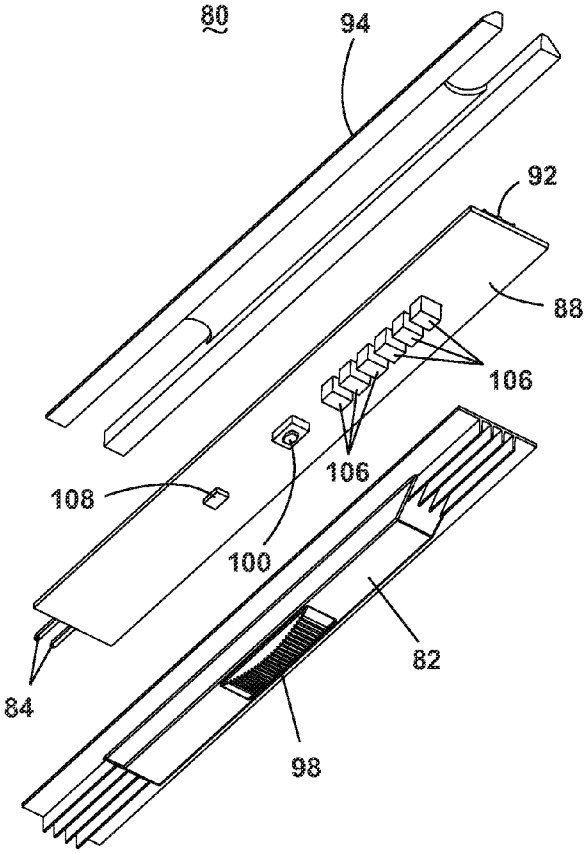
FIG. 7 is an exploded view from the top of the switch module portion of the lighting module assembly.
Figure 6:
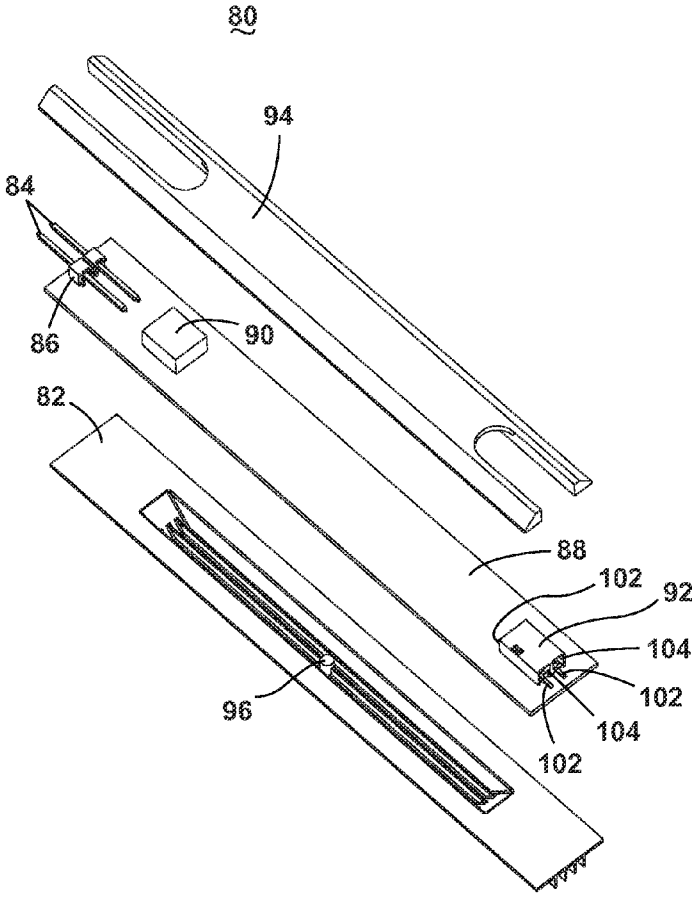
FIG. 6 is an exploded view from the bottom of the switch module portion of the lighting module assembly.

FIGS. 6 and 7 show an exploded view of the switch module portion from the bottom and top, respectively. There is a switch circuit board 88 disposed between the top switch cover 82 and the bottom switch spacer 94. The switch female electrical input 86 is electrically and mechanically attached to the switch circuit board 88 by well known means such as by solder. The electrical prongs of the male to male terminal connector 84 engage with the female electrical cavities 74 of the electrical output 62 of the power module portion 50 and the switch female electrical input 86. The switch circuit board 88 may have electrical traces (not shown) with components 90, 92, 100, 106 and 108 assembled on both sides. The electrical current from the power module portion 50 is conducted through the switch electrical input 86 via the traces on the switch circuit board and conducted to the various components 90, 92, 100, 106 and 108. Some of the components 90, 106 and 108 may serve as power regulators, spark gaps, fuses, resisters, or other known electrical components. One of the components is a switch component 100 with a means of switching on or off the current conduction from the switch electrical input 86 to the switch power output 92. There is a protrusion 96 on the inside of the top switch cover 82 that presses against the switch component 100 to actuate the switch component 100 to turn the modular lighting assembly 30 on or off. There is a depressible portion 98 on the top switch cover 82 that can be pressed by a user wishing to turn the modular lighting assembly on or off. The depressible portion 98 in turn transfers the lateral motion from the press to the protrusion 96 that in turn actuates the switch component 100. The switch power output 92 is attached to the switch circuit board 88 by electrical connectors 102. The switch power output 92 has a switch output female electrical connector 104 that mates via a loose male-to-male terminal connector 114 with the lighting power input female connector 116 of the lighting module portion 110.

The spacer 94 is typically fabricated by extrusion of an aluminum form and stamping to shape the final spacer. The spacer 94 may be shaped in a manner to maximize contact area with the modular framing profiles 20 when the modular lighting assembly 30 is slid into one of the slots 22 and held in place by the lobes 24 of the modular framing profiles 20. An increase surface area of contact between the switch spacer 94 and the modular framing profiles 20 provides acceptable sliding friction when fabricated in aluminum, a reduced thermal resistance and therefore greater thermal conduction away from the switch and lighting elements.

As an alternative, the switching mechanism may be a rotating member or any other know switch mechanism rather than a push button mechanism comprised of the depressible portion 98, the protrusion 96, and the switch component 100, as shown here. Additionally, the switch mechanism may be replaced with a rheostat to regulate the amount of current conducted, and thereby control the intensity of the modular lighting assembly rather than turning the modular lighting assembly on or off. As a further alternative, the bottom switch molded spacer 94 may become an aluminum heat spreader if the switch module portion 80 generates excessive heat.

Figure 8:
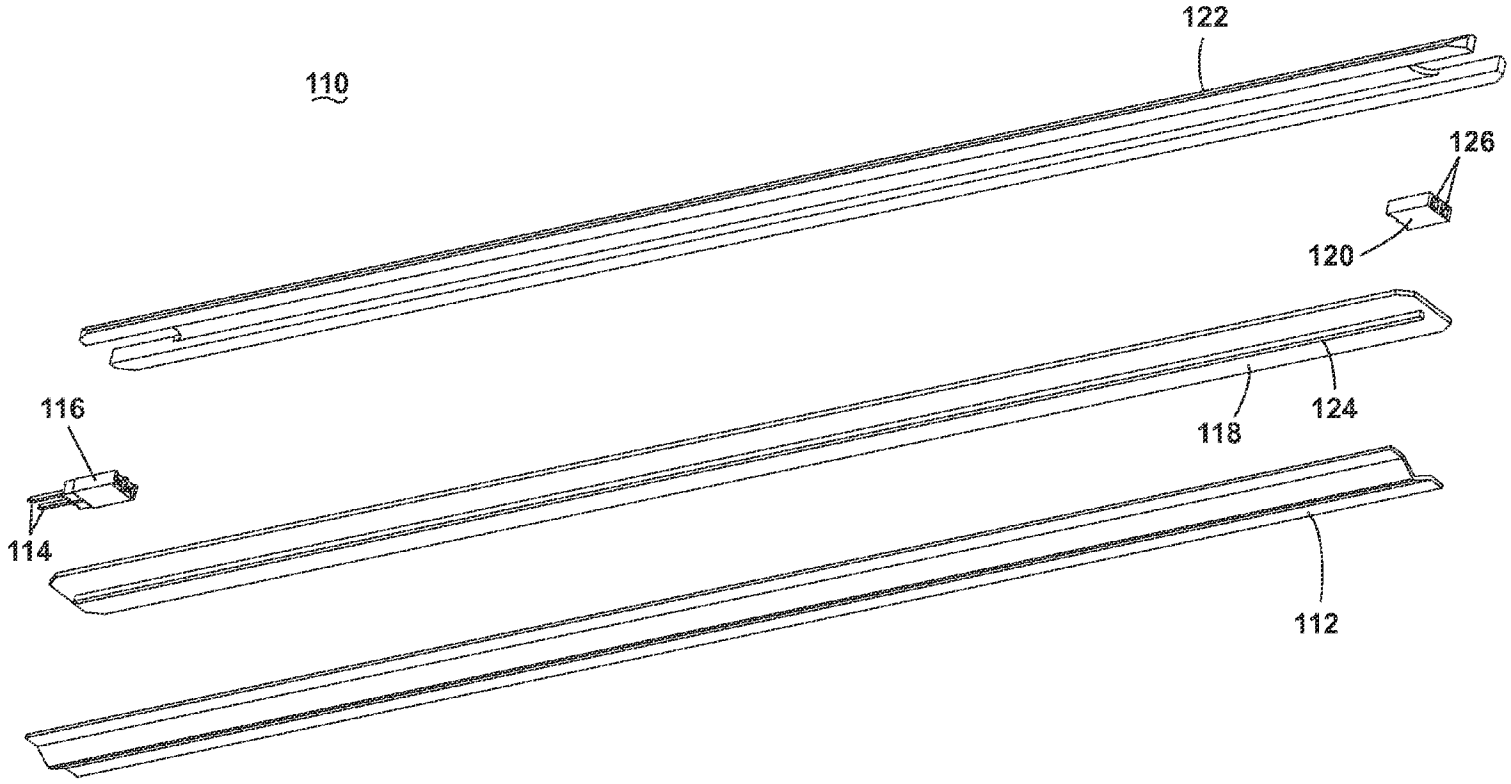
FIG. 8 is an exploded view of a lighting module portion of the lighting module assembly.

FIG. 8 shows an exploded view of the lighting module portion 110 of the modular lighting assembly 30. There is a lighting circuit board 118 disposed between the lighting module cover 112 and a lighting heat spreader 122. Disposed on the bottom of the lighting circuit board 118 is the lighting electrical input female connector 116 with the loose male-to-male terminal connector 114 that interfaces between the electrical input female connector 116 and the switch output female electrical connector 104. There is also a lighting electrical output component 120 with female electrical interfaces 126 attached to the bottom of the lighting circuit board 118. Both ends of the lighting module portion has female connectors 116 and 120 so that the lighting module portion 110 can the connected to the switch portion 80 or directly to the power module portion 50 from either end. This lighting electrical output component 120 can further be used to daisy chain or connect multiple modular lighting assemblies 30 in series by connecting the power cord 52 of the power module portion 50 of one modular lighting assembly 30 to the electrical output component 120 of the lighting module portion 110 of another modular lighting assembly 30.

There is a lighting element 124 disposed on the top of the lighting circuit board 118. When current is passed through the lighting element 124 via the lighting electrical input 116 and electrical traces (not shown) on the lighting circuit board 118, the lighting element provides illumination. The lighting element 124 may contain light emitting diodes (LEDs) and produce light of white or any color. To produce white light, the lighting element 124 may contain LEDs of blue, red and green wavelengths. Red LEDs are typically fabricated with group III-V materials such as Gallium Arsenide (GaAs) or Aluminum Gallium Arsenide (AlGaAs), and green and blue LEDs are typically fabricated from group III-V materials such as Indium Gallium Nitride (InGaN) or Aluminum Gallium Phosphide (AlGaP), or group II-VI materials such as Zinc Selenide (ZnSe). Alternatively, the lighting element may contain blue or UV wavelength with protective covers coated with phosphor of various colors to shift output wavelength from the shorter blue/UV wavelength to a range of longer wavelengths to produce a white or near-white optical output. The LEDs may be in the form of a strip along the full length of the lighting element 124.

The lighting element 124 may also provide colored lighting, such as red, blue, or green. The colored lighting may be achieved by using LEDs of a particular wavelength as discussed above, without mixing with LEDs of other colors to produce white light. Additionally, a colored light output may be achieved by having a colored lighting module cover 112 to filter the optical output of the lighting element 124 and only provide the wavelengths desired.

The lighting module portion 110 may further contain a reflector element on the top of the lighting circuit board 118 to reflect light away from the lighting circuit board 118 to the lighting module cover 112 to effectively use the optical output to provide the desired illumination rather than waste the optical output. In addition, a lense can be provided to focus the light from the fixture. The lighting module cover 112 may have a surface texture or optical properties to produce a diffuse illumination output. The lighting module cover 112 may be fabricated using a low cost extrusion process or any other known method of fabrication. As an alternative to inorganic LED based lighting, the lighting element may contain organic light emitting diodes (OLEDs) or conventional incandescent filament based lighting.

Figure 9:
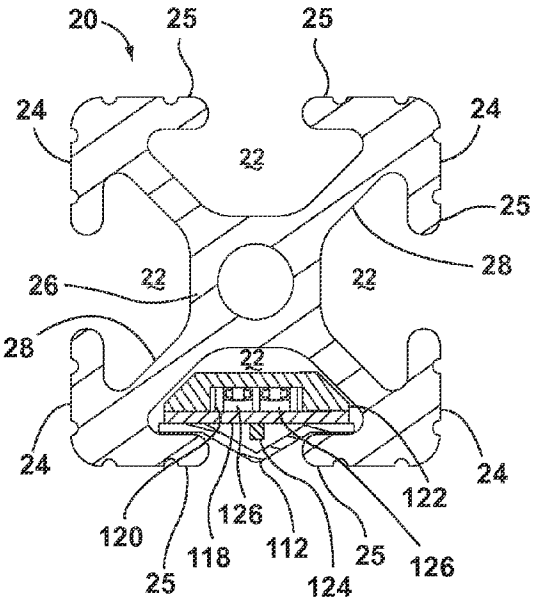
FIG. 9 is a cross sectional view taken along lines 9-9 of FIG. 3.

FIG. 9 shows a view from the end of the modular framing profiles 20 with the modular lighting assembly disposed within one of slots 22 of the modular framing profiles 20 and held in place by two of the lobes 24 of the modular framing profiles 20. The lighting heat spreader 122 is configured to complement the profile of the slots 22 so that the outer surface of the heat spreader 122 is in close proximity to or actually touches the legs 28 and the lobes 24 of the modular framing profiles 20 to dissipate heat from the lighting elements and circuit board through the profiles 20 as illustrated in FIG. 9. The lighting module cover 112 rests on the lips 25 of the modular framing profiles. The ridge portion of the lighting module cover 112 may extend outside of the slot as defined by the lips 25 of the modular framing profiles 20. The end of the lighting element 124 disposed on the lighting circuit board 118 on one side and the end of the lighting electrical output component 120 with female electrical interfaces 126 disposed on the other side of the lighting circuit board 118 is visible from the end of the modular framing profiles 20 with modular lighting assemblies 40. In one implementation, a thermal interface material (TIM) or thermal grease may be provided between the lighting heat spreader 122 and the lobes 24 of the modular framing profiles 20. The use of such materials may improve heat conduction from the lighting structure to the modular framing profiles 20.

Figure 10:
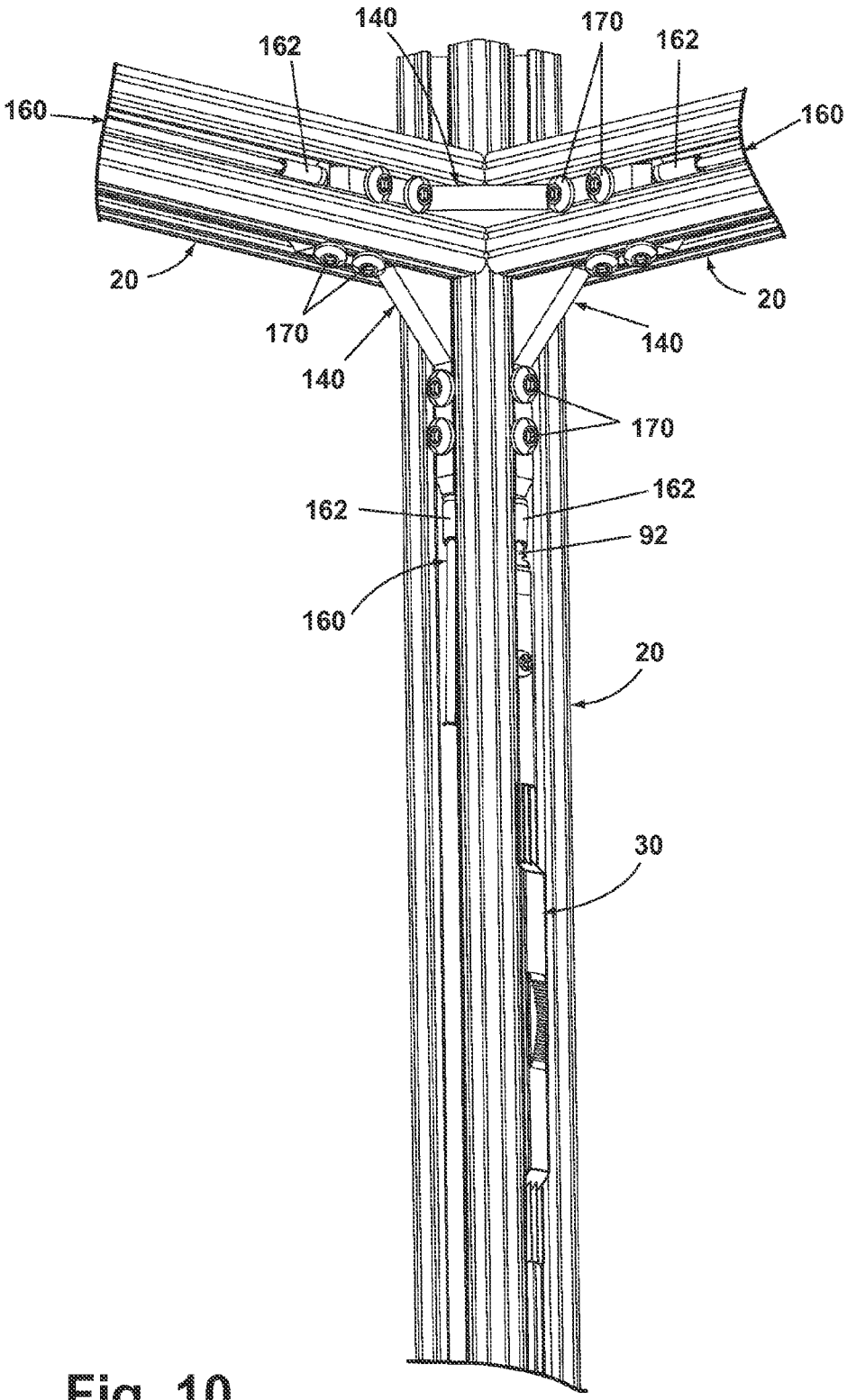
FIG. 10 is a perspective view of three corner connectors connecting three modular framing profiles together both mechanically and electrically.

FIG. 10 shows three corner connectors 140 connecting three modular framing profiles 20 together. These corner connectors 140 are partially disposed within slots 22 and secured to the modular framing profiles 20 by screws 170. Electrical cords 160 may be disposed within the slots 22 and are used to provide electrical pathways along the length of the modular framing profiles 20 with insulated wires 164 between two connector portions 162. These electrical cords 160 are plugged in to the corner connectors to provide electrical pathways from one electrical cord to another. Therefore, the corner connector 140 provides both mechanical and electrical connections between two modular framing profiles 20. The electrical cords plug in to the corner connectors with cord connector portion 162. The power cord 52 of the modular lighting assembly 30 may plug into electrical corner connector to provide power to the modular lighting assembly 30 disposed within a slot 22 of the modular framing profiles 20.

Figure 11:
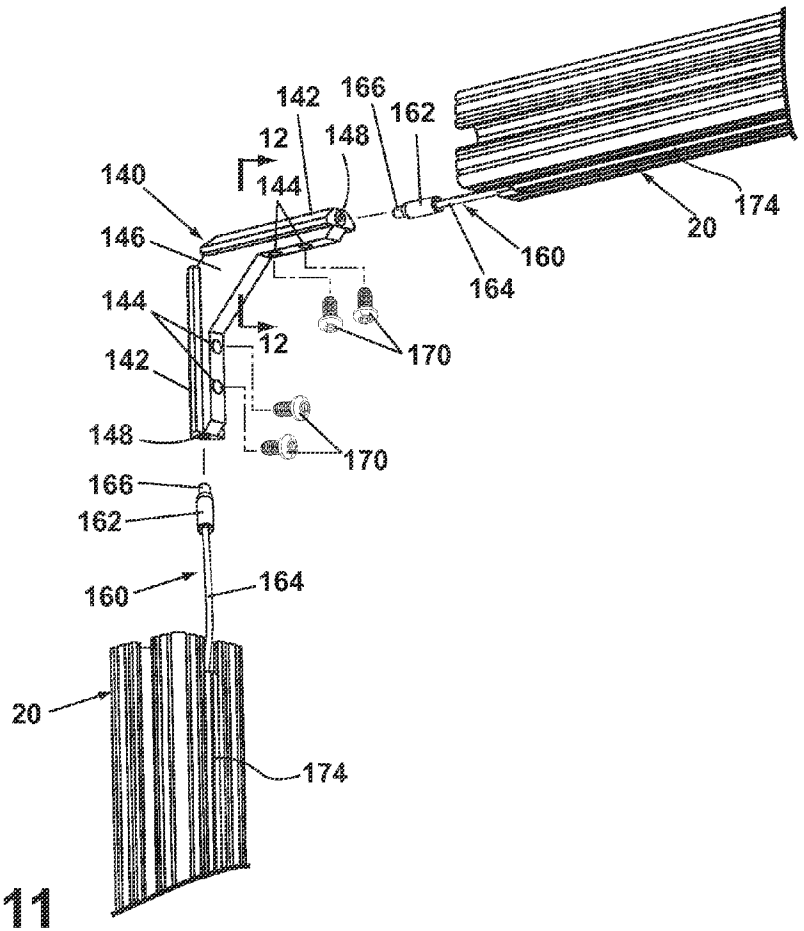
FIG. 11 is an exploded view of a corner connector connecting two modular framing profiles.

FIG. 11 shows an exploded view of a corner connector 140 connecting two modular framing profiles. The corner connector 140 has two guide elements 142 each of which slides into slots 22 of two different modular framing profiles 20 to connect the two modular framing profiles in a perpendicular orientation. There is a corner element 146 that provides structural strength to the corner connector 140. There are holes 144 passing through the guide elements 142 which are provided for screws 170 securing the corner connector 140 to the modular framing profiles 20. The mechanical aspect of the corner connector have been described in detail in U.S. Pat. No. 6,481,177 to 80/20, Inc., and is hereby incorporated by reference. The corner connector 140 described herein also has a two electrical input/output 148 on the end of each of the two guide elements. These electrical input/output 148 conduct electricity from one of the electrical input/output 148 to the other and are suited to connect with connector tip 166 of the electrical cord 160, where the connector tip 166 is pushed in to the electrical input output 148 by holding the cord connector portion 162.

There is also provided a wire cover 174 that slides over the electrical cord 160. The wire cover 174 provides an improved aesthetic appearance of the modular framing profile 20 with electrical cords 160 within slots 22. Additionally the wire cover 174 may provide an electrical safety advantage as it prevents direct access to the electrical cords 160 carrying electricity within the slots 22. The wire covers 174 may be used to cover electrical cords between corner connectors 140 or between two or more modular lighting assemblies 30. If any of the lighting module portion 110, the switch module portion 80, and the power module portion 50 are connected to each other via connector wires, a wire cover 174 may be disposed over the connector wires disposed between the various portions 50, 80, and 110. A wire cover 174 may also be of various lengths to accommodate variable distances of electrical wiring and cords.

Figure 12:
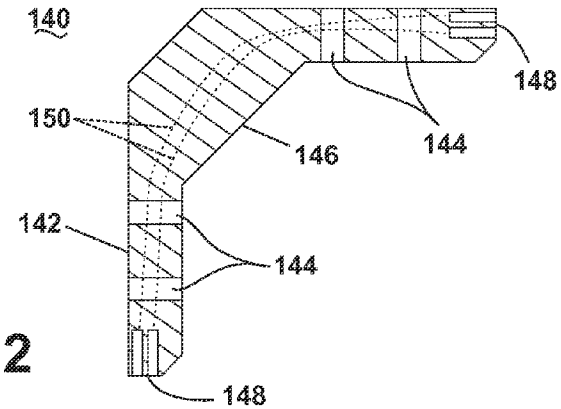
FIG. 12 is a cross-sectional view of the corner connector shown in FIGS. 10 and 11.

A cross-sectional view of the corner connector is shown in FIG. 12. There are holes 144 passing through the two perpendicular guide elements 142 for securing the corner connector 140 to modular framing profiles 20. There is also a pair of wires 150 that pass through the corner connector 150 that electrically connects the two electrical input/outputs 148. The corner connector 140 may be constructed by casting of brass or stainless steel. If the corner connector is constructed of an electrically conductive material, then the pair of wires 150 must be covered with an electrically insulative material to prevent electrical conduction from the wires to the body of the corner connector 140. Alternatively, the corner connector 140 may be fabricated by injection molding of thermoplastic materials. If an electrically insulative material is used for constructing the corner connector, then the wires 150 do not require an electrically insulative covering. The pair of wires may be carrying direct current (DC) with one of the wires of the pair being grounded and the other of the pair at the voltage required to power the modular lighting assembly.

Figure 14:
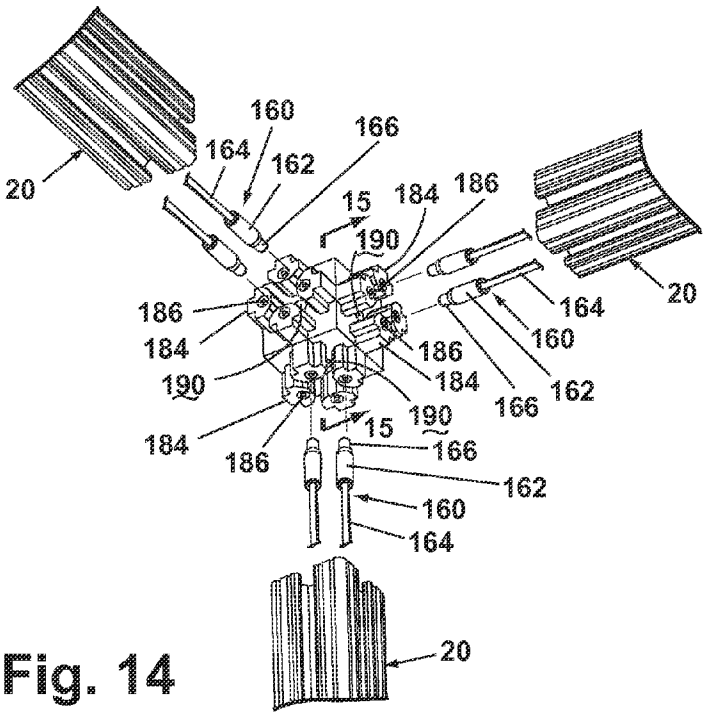
FIG. 14 is an exploded view of the corner block connector of FIG. 17 and associated electrical components and three modular framing profiles.
Figure 13:
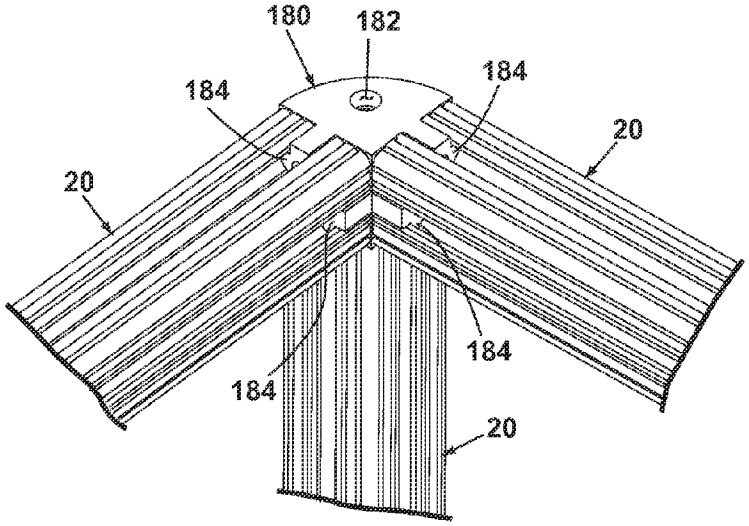
FIG. 13 is a perspective view of a corner block connector connecting three modular framing profiles both mechanically and electrically.

FIG. 13 shows a corner block corner connector 180 connecting three modular framing profiles 20 both mechanically and electrically. There are three holes 182 disposed in the corner block corner connector 180 to allow a screw (not shown) to secure the corner block corner connector 180 to the modular framing profiles 20. FIG. 14 shows an exploded view of the corner block corner connector 180 connecting three modular framing profiles 20. There are four guide members 184 on each face of the corner block corner connector. These four guide members are shaped and spaced to slidably fit into the slots 22 of a modular framing profiles that is being attached to face on which the four guide members 184 are located. Each of the guide members also have an electrical input/output 186, into which the connector tip 166 is pushed in by holding the cord connector portion 162 of an electrical cord 160. Electrical cords 160 may be disposed within the slots 22 and are used to provide electrical pathways along the length of the modular framing profiles 20 with insulated wires 164 between two connector portions 162. These electrical cords 160 are plugged in to the corner block corner connector 180 to provide electrical pathways from one electrical cord to another. The power cord 52 of the modular lighting assembly 30 may also plug into the corner block corner connector 180 to provide power to the modular lighting assembly 30 disposed within a slot 22 of the modular framing profiles 20. Therefore, the corner block corner connector 180 provides both mechanical and electrical connections between two or three modular framing profiles 20.

Figure 15:
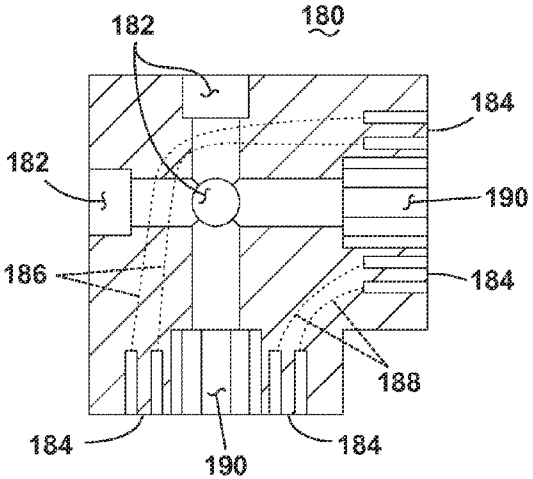
FIG. 15 is a cross-sectional view of the corner block connector of FIGS. 17 and 18 taken through two pairs of electrical input/outputs.

FIG. 15 shows a cross-sectional view of the corner block corner connector 180 cutting through two pairs of electrical input/outputs 184. There are three holes 182 into which screws are disposed to secure the corner block corner connector 180 to the modular framing profiles 20.

There may be a pair of wires 186 that connect one pair of electrical input/output 184 and another pair of wires 188 that connect another pair of electrical input/output 184. The power cord 52 of the modular lighting assembly 30 may plug into electrical input/output 184 of the block corner connector 180 to provide power to the modular lighting assembly 30 disposed within a slot 22 of the modular framing profiles 20. Like the corner connector 140, the block corner connector 180 may be fabricated by casting of brass or stainless steel or by injection molding of thermo-plastic materials.

Figure 16:
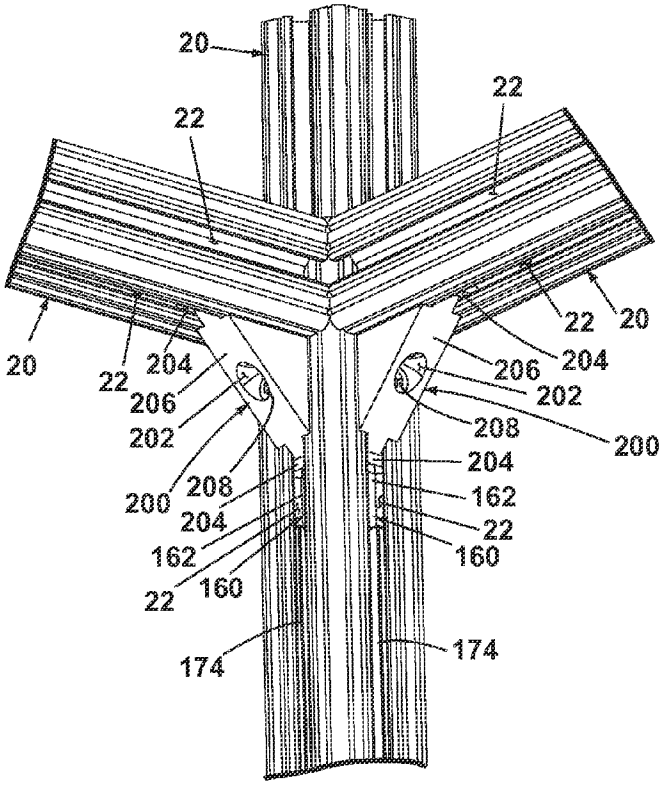
FIG. 16 is a perspective view of two corner gusset connecting three modular framing profiles.

FIG. 16 shows two corner gusset pieces 200 connecting three modular framing profiles 20. These corner gusset pieces 200 have guide elements 204 that are disposed within slots 22 and secured to the modular framing profiles 20 by screws 208. These guide elements 204 are only partially visible in this view and can be seen more clearly in FIG. 17. There are holes 202 in the corner gusset piece 200, into which the screws disposed to connect the corner gusset piece 200 to the modular framing profiles 20. There is also a corner element 206 that provides structural strength to corner gusset piece 200. Electrical cords 160 may be disposed within the slots 22 and are used to provide electrical pathways along the length of the modular framing profiles 20 with insulated wires 164 between two connector portions 162. These electrical cords 160 are plugged in to the corner gusset pieces 200 to provide electrical pathways from one electrical cord 160 to another. Therefore, the corner gusset piece 200 provides both mechanical and electrical connections between two or more modular framing profiles 20. The electrical cords plug into the corner gusset pieces 200 with cord connector portion 162. There is also provided a wire cover 174 that slides over the electrical cord 160 within the slot 22. The power cord 52 of the modular lighting assembly 30 may also plug into electrical corner connector to provide power to the modular lighting assembly 30 disposed within a slot 22 of the modular framing profiles 20.

Figure 17:
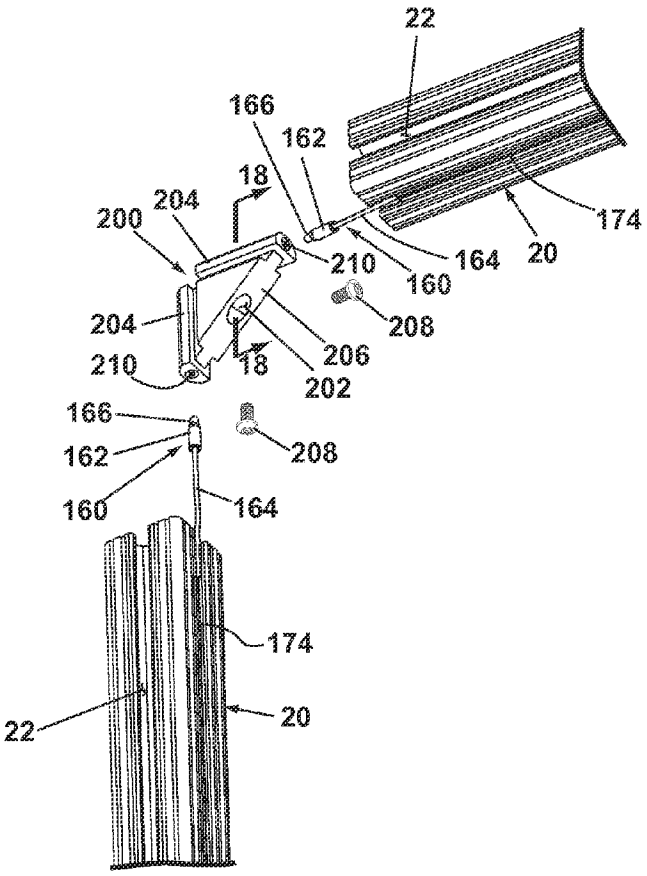
FIG. 17 is an exploded view of a corner gusset with associated electrical components and two modular framing profiles.

FIG. 17 shows an exploded view of a corner gusset pieces 200 connecting two modular framing profiles 20. The two guide elements 204 of the corner gusset piece 200, each of which slides into slots 22 of two different modular framing profiles 20 to connect the two modular framing profiles 20 in a perpendicular orientation can be clearly seen in this view. The corner element 206 that provides structural strength to the corner gusset piece 200 is a triangular shape provided between the two substantially perpendicular guide elements 204. There are holes 202 passing through the corner element 206 and the guide elements 208 which are provided for screws 208 securing the corner gusset piece 140 to the modular framing profiles 20. The mechanical aspects of the corner gusset piece have been described in detail in U.S. Pat. No. 6,481,177 to 80/20, Inc. The corner gusset piece 200 described herein also has a two electrical input/output 210 on the end of each of the two guide elements 204. These electrical input/output 210 conduct electricity from one of the electrical input/output 210 to the other and are suited to connect with connector tip 166 of the electrical cord 160, where the connector tip 166 is pushed in to the electrical input output 210 by holding the cord connector portion 162.

Figure 18:
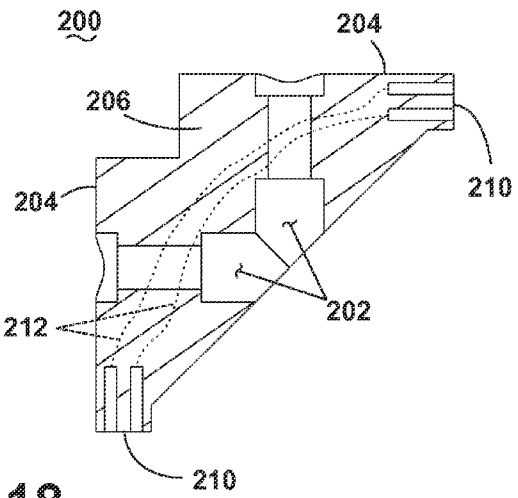
FIG. 18 is a cross sectional view of the corner gusset of FIGS. 16 and 17, taken along lines 18-18 of FIG. 17.

FIG. 18 shows a cross sectional view of a corner gusset piece 200. There are holes 202 passing through the two perpendicular guide elements 204 for securing the corner connector 200 to modular framing profiles 20. There is also a pair of wires 212 that pass through the corner gusset piece 200 that electrically connects the two electrical input/outputs 210. The corner gusset piece 200 may be constructed by casting of brass or stainless steel. If the corner connector is constructed of an electrically conductive material, then the pair of wires 212 must be covered with an electrically insulative material to prevent electrical conduction from the wires to the body of the corner gusset piece 200. Alternatively, the corner gusset piece 200 may be fabricated by injection molding of thermoplastic materials. If an electrically insulative material is used for constructing the corner connector, then the wires 212 do not require an electrically insulated covering. The pair of wires may be carrying direct current (DC) with one of the wires of the pair being grounded and the other of the pair at the voltage required to power the modular lighting assembly.

Figure 19:
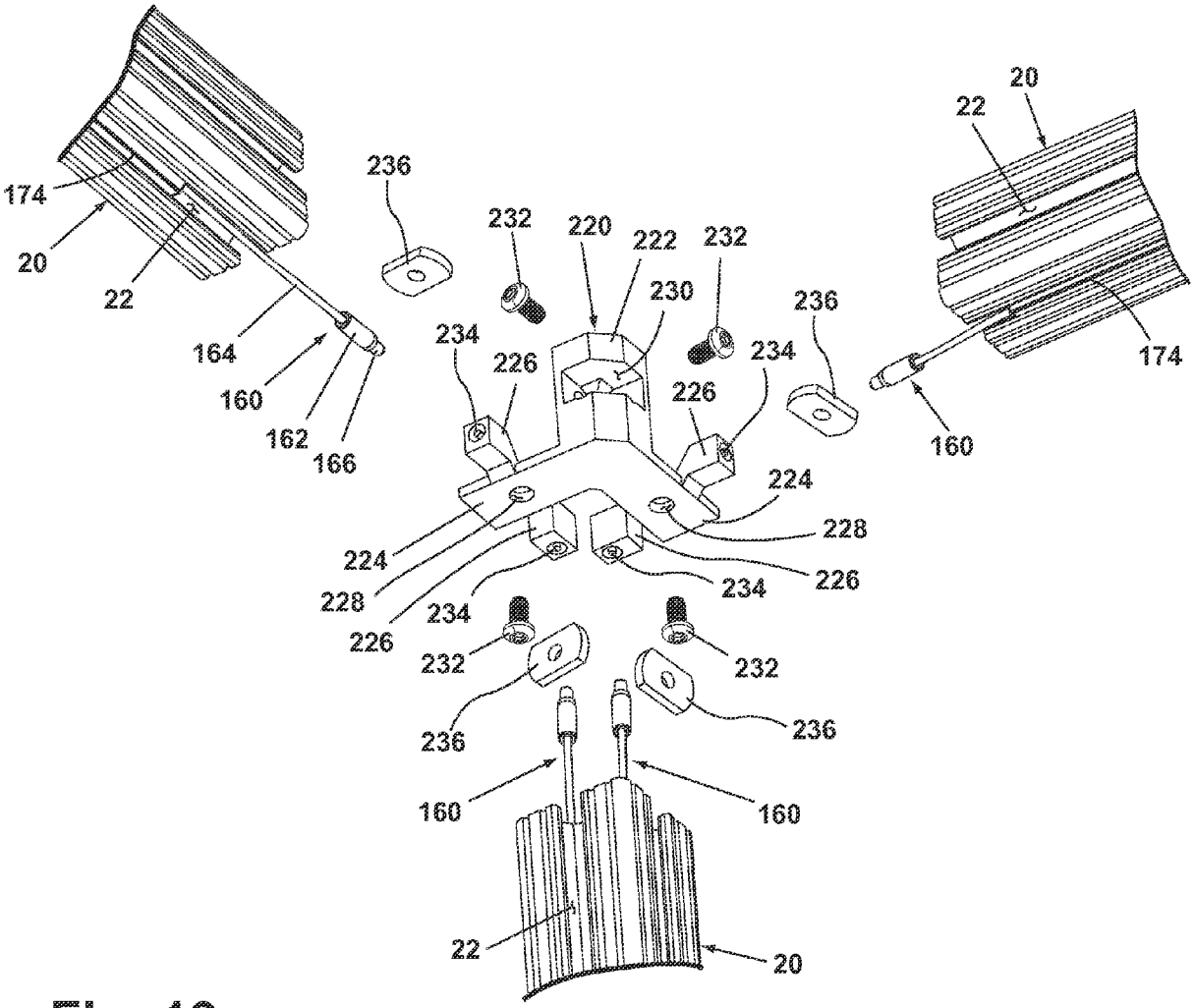
FIG. 19 is an exploded perspective view of three modular framing profiles mechanically and electrically connected together with a tri-corner connector.

FIG. 19 shows a tri-corner connector 220 for connecting up to three modular framing profiles 20 together at any place along the vertical frame profile as viewed in FIG. 19. The tri-corner connectors 220 has guide elements 226 that are configured to slide within slots 22 of the modular framing profiles 20 from one end of the modular framing profiles 20. The tri-corner connector has a post element 222, which has a cavity 230 for screws 232 which are threaded onto nuts 236 to secure the tri-corner connector 220 to the modular framing profiles 20. Typically, the screws 232 thread onto nuts 236 prior to insertion of the tri-corner connector 220 onto the vertical frame profile 20 and then are tighten to secure tri-corner connector 220 onto the vertical frame profile 20 when the tri-corner connector 220 is positioned at the desired height on the vertical frame profile 20. The nuts 236 are shaped to be slidably received in the slots 22 and rest against the legs 25. The tri-corner connector 220 also contains two platform elements 224 on which the guide elements 226 are provided. Two of the modular framing profiles 20 sit on the two platform elements 224 and are secured to the platform elements with screws 232 attached to nuts 236 through holes 228 in the platform elements 224. The third modular framing profile (shown in the vertical direction) 20 does not support the platform elements 224; instead, it extends along the opposite side of the post element 222 and is secured to the vertical frame profile 20 using screws 232 secured to nuts 236 through the cavity 230. The tri-corner connector 220 can connect one or two horizontal framing profiles 20 to the vertical framing profile 20 anywhere along the length of the vertical framing profile 20. The tri-corner connector 220 also connects three modular framing profiles 20 near the ends of those structures. Like the other corner connectors, the tri-corner connector provides both mechanical and electrical connections between modular framing profiles 20. The tri-corner connector 220 also has four electrical input/output 234 on the end of each of the four guide elements 226. These electrical input/output 234 conduct electricity from one of the electrical input/output 210 to the other and are suited to connect with connector tip 166 of the electrical cord 160, where the connector tip 166 is pushed in to the electrical input/output 234 by holding the cord connector portion 162. The electrical cords 160 can provide power to the tri-corner connector 220 and be connected to a power connector 42 as depicted in FIG. 3.

There are several advantages to modular lighting assemblies and the electrical connectors described herein. Modular framing profiles are commonly used to quickly and cost effective construction of modular frame assemblies for enclosures, furniture, displays, and other applications without the need for welding. These assemblies and applications often require lighting. For example, for a display assembly constructed at a trade show, one might want to provide adequate lighting to so that the items on display can be easily seen by visitors. Without the modular lighting assemblies and connectors disclosed herein, providing lighting for these assemblies may require lamps to be clipped on to the assemblies with visible power cords strung over the framing structures. To provide a sufficient amount of light, several lamps may be required. As a result, the lamps and the associated wiring may reduce the aesthetic appeal of the assembly, be expensive, and may add weight to the assemblies, provide inconsistent or insufficient light, and take up space within the assemblies. The modular lighting assemblies disclosed herein provide a means of integrating the lighting right into the framing assembly, without electrical cords and wires strewn about the structure, and without adding much weight or requiring much additional space. Because the cords and the wiring run within the slots of the modular framing profiles and the power is transferred from one cord to another by way of corner connectors, the cord are barely visible, and provide a great deal of aesthetic appeal.

Additionally the modular lighting assemblies are especially suited for highly efficient LED lighting, providing a low cost, lightweight, long lasting, reliable, low power consuming, and environmentally benign source of light. By providing the modular lighting assemblies along various modular framing profiles that form the framing assembly, a more uniform lighting can be provided then one or two bright incandescent spotlight-type lights. Additionally the structure disclosed uses the modular framing profiles, constructed of aluminum with high thermal conductivity, to dissipate heat away from the modular lighting assemblies and cool the modular lighting assemblies to provide safe operation. In comparison, an incandescent light providing the same illumination as the LED based modular lighting assemblies may be painful to a person that touches the light source.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A modular frame assembly with modular lighting assemblies comprising:

a plurality of elongated modular structural frame profiles joined together at the ends thereof with corner connectors to form a support structure, each of the modular frame profiles having at least one longitudinal slot extending along the length of the profile and inwardly directed lips that slidably retain the at least one modular lighting assembly;

at least one modular lighting assembly disposed within the at least one slot of at least one of the plurality of modular frame profiles, wherein the at least one modular lighting assembly comprises at least one illumination element mounted on a circuit board; a heat spreader mounted on the circuit board, wherein the heat spreader is configured to complement the profile of the at least one longitudinal slot so that the outer surface of the heat spreader is in close proximity to the interior walls of the at least one longitudinal slot;

a power source electrically connected to the at least one modular lighting assembly to energize the at least one modular lighting assembly to provide visible radiation external to the modular frame assembly.

2. The modular frame assembly of claim 1, wherein at least one of the corner connectors provides electrical connection between each of the connecting modular frame profiles.

3. The modular frame assembly of claim 1 wherein the at least one modular lighting assembly further comprises a power module and a switch connected between the power module and the at least one modular lighting assembly.

4. The modular frame assembly with modular lighting assemblies of claim 1, wherein the at least one illumination element comprises at least one light emitting diode (LED).

5. The modular frame assembly with modular lighting assemblies of claim 1, wherein the at least one modular lighting assemblies further comprises at least one reflective element.

6. The modular frame assembly claim 1, wherein the at least one modular lighting assemblies further contains at least one optically diffusive element.

7. The modular frame assembly of claim 1, wherein the at least one modular lighting assembly is slidably disposed within the at least one slot of the at least one of the plurality of modular frame profiles.

8. A modular lighting assembly comprising:

an elongated structural frame profile that has at least one longitudinal slot extending along the length of the frame profile, wherein the modular frame profile slot comprises retaining lips defining an opening in the elongated slot;

a power module;

a lighting module comprising:

a heat spreader configured to complement the profile of the at least one longitudinal slot so that the outer surface of the heat spreader is in close proximity to interior walls of the at least one longitudinal slot; and a circuit board mounted to the heat spreader and including traces that provide electrical pathways and at least one illumination element; and wherein the power module is electrically connected to the traces on the circuit board, the traces on the circuit board are electrically connected to the at least one illumination element to enable power transfer from the power module to the at least one illumination element, and wherein the power module and the lighting module are slidably received wholly within the elongated slot of the modular frame profile and retained therein by the retaining lips.

9. The modular lighting assembly of claim 8 wherein the at least one illumination element is a light emitting diode (LED).

10. An illumination assembly for work areas and the like comprising a structural frame profile that has at least one longitudinal slot extending along the length of the frame profile, wherein the at least one longitudinal slot has retaining lips defining an opening to the elongated slot, and a modular lighting assembly according to claim 8 slidably mounted in the at least one longitudinal slot.

11. The modular frame assembly with modular lighting assemblies comprising:

a plurality of modular structural frame profiles joined together to form a support structure, each of the modular frame profiles having at least one longitudinal slot extending along the length of the profile;

at least one modular lighting assembly at least partially disposed within the at least one slot of at least one of the plurality of modular frame profiles; and a power source to energize the at least one modular lighting assembly to provide visible radiation external to the modular frame assembly:

wherein the modular frame includes frame profiles are joined together at right angles with a corner connector, wherein the corner connector comprises:

a body having a first guide that is configured to be slidably received in at least one elongated slot of a frame profile;

a second guide that is adapted to be slidably received in the at least one elongated slot of an adjacent frame profile;

an electrical input disposed at a distal end of the first guide; and an electrical output disposed at a distal end of the second guide wherein the electrical input and electrical output are electrically connected to each other;

a mechanical connector mounted in the body adjacent to each of the first and second guides to mechanically secure the frame profile connector to the two adjacent frame profiles.

12. A modular frame assembly with modular lighting assemblies comprising:

a plurality of modular structural frame profiles joined together to form a support structure, each of the modular frame profiles having at least one longitudinal slot extending along the length of the profile;

at least one modular lighting assembly at least partially disposed within the at least one slot of at least one of the plurality of modular frame profiles; and a power source to energize the at least one modular lighting assembly to provide visible radiation external to the modular frame assembly;

wherein the at least one modular lighting assembly comprises at least one illumination element mounted on a circuit board; a heat spreader mounted on the circuit board, wherein the heat spreader is configured to complement the profile of the at least one longitudinal slot so that the outer surface of the heat spreader is in close proximity to interior walls of the at least one longitudinal slot.

13. The modular frame assembly of claim 12 wherein the at least one modular lighting assembly further comprises a power module and a switch connected between the power module and the at least one modular lighting assembly.

14. The modular frame assembly of claim 13 wherein the at least one illumination element comprises at least one light emitting diode (LED) and wherein the at least one modular lighting assembly further contains at least one optical cover in operative position with respect to the at least one light emitting diode (LED) to pass illumination from the at least one light emitting diode (LED) to provide visible radiation external to the modular frame assembly, and wherein the circuit board, the power module, the switch and the optical cover are mounted within the elongated slot.

15. The modular frame assembly of claim 14 wherein the optical cover has optical properties to produce a diffuse illumination output.

16. The modular frame assembly with modular lighting assemblies of claim 12 wherein the at least one illumination element comprises at least one light emitting diode (LED).

* * * * *